US009447635B2

(12) United States Patent
Derk

(10) Patent No.: US 9,447,635 B2
(45) Date of Patent: Sep. 20, 2016

(54) MOTORIZED ROLLER SHADE SYSTEM WITH A SUN ANGLE SENSOR

(71) Applicant: Crestron Electronics, Inc., Rockleigh, NJ (US)

(72) Inventor: Charles Derk, Park Ridge, NJ (US)

(73) Assignee: CRESTRON ELECTRONICS, INC., Rockleigh, NJ (US)

( * ) Notice: Subject to any disclaimer, the term of this patent is extended or adjusted under 35 U.S.C. 154(b) by 0 days.

(21) Appl. No.: 14/284,712

(22) Filed: May 22, 2014

(65) Prior Publication Data

US 2014/0345807 A1 Nov. 27, 2014

Related U.S. Application Data

(60) Provisional application No. 61/826,618, filed on May 23, 2013.

(51) Int. Cl.
*E06B 9/68* (2006.01)
*E06B 9/42* (2006.01)

(52) U.S. Cl.
CPC . *E06B 9/68* (2013.01); *E06B 9/42* (2013.01); *E06B 2009/6827* (2013.01)

(58) Field of Classification Search
CPC ..... E06B 2009/6827; E06B 2009/6845
USPC ..... 160/5, 7, 310
See application file for complete search history.

(56) References Cited

U.S. PATENT DOCUMENTS

| | | | | |
|---|---|---|---|---|
| 5,142,133 | A * | 8/1992 | Kern et al. | 250/203.4 |
| 5,467,266 | A * | 11/1995 | Jacobs et al. | 700/56 |
| 5,663,621 | A * | 9/1997 | Popat | 318/480 |
| 6,082,433 | A * | 7/2000 | Vafaie et al. | 160/310 |
| 6,100,659 | A * | 8/2000 | Will et al. | 318/466 |
| 7,111,952 | B2 * | 9/2006 | Veskovic | 362/1 |
| 7,389,806 | B2 * | 6/2008 | Kates | 160/5 |
| 7,445,035 | B2 * | 11/2008 | Bruno et al. | 160/310 |
| 7,468,591 | B2 * | 12/2008 | Bruno | 318/467 |
| 7,737,653 | B2 * | 6/2010 | Carmen et al. | 318/466 |
| 7,977,904 | B2 * | 7/2011 | Berman et al. | 318/480 |

* cited by examiner

*Primary Examiner* — David Purol

(57) ABSTRACT

Presented is a motorized roller shade system. The system includes a flexible shade material, a roller tube configured for windingly receiving the flexible shade material, a shade motor coupled to the roller tube, a motor controller in communication with the shade motor, and a sun angle sensor. The sun angle sensor is configured for determining the angle of the sun and transmitting the angle of the sun to the motor controller. The motor controller is configured for driving the shade motor to rotate the roller tube to wind or unwind the flexible shade material in response to the transmitted angle of the sun to limit sunlight penetration to a predetermined maximum distance into a room.

5 Claims, 4 Drawing Sheets

MOTORIZED ROLLER SHADE SYSTEM WITH A SUN ANGLE SENSOR

BACKGROUND OF THE INVENTION

1. Technical Field

The present disclosure relates generally to roller shades, and more particularly to a motorized roller shade with a sun angle sensor.

2. Background Art

Typical motorized roller shades provide privacy, glare control, minimize heat gain, and prevent damage to interior furnishings by minimizing the effects of ultra violet radiation from the sun. In order to realize these benefits, roller shades are manually adjusted by the occupant to solve one or more of the above-mentioned issues.

SUMMARY OF THE INVENTION

It is to be understood that both the general and detailed descriptions that follow are exemplary and explanatory only and are not restrictive of the invention

DISCLOSURE OF THE INVENTION

According to one aspect, the invention involves a motorized roller shade system. The system includes a flexible shade material, a roller tube configured for windingly receiving the flexible shade material, a shade motor coupled to the roller tube, a motor controller in communication with the shade motor, and a sun angle sensor. The sun angle sensor is configured for determining the angle of the sun and transmitting the angle of the sun to the motor controller. The motor controller is configured for driving the shade motor to rotate the roller tube to wind or unwind the flexible shade material in response to the transmitted angle of the sun to limit sunlight penetration through a window to a predetermined maximum distance into a room.

In one embodiment, the roller shade system further includes a memory configured for storing a height of the window covered by the flexible shade material and a height of a window sill associated with the window.

In another embodiment, the motor controller is further configured for driving the shade motor to rotate the roller tube to wind or unwind the flexible shade material in response to the stored height of the window and the stored height of the window sill associated with the window to limit sunlight penetration through the window to a predetermined maximum distance into the room.

In still another embodiment, the motor controller includes a microcontroller, a controller interface, a memory, and a motor driver circuit in communication with the motor.

In various embodiments, the sun angle sensor is solar powered, and the sun angle sensor transmits the angle of the sun to the motor controller through one of a wired connection and a wireless connection.

According to another aspect, the invention involves a method of limiting the maximum distance sunlight penetrates through a window into a room. The method includes providing for the window a roller shade that includes a flexible shade material, a motor, a motor controller, and a sun angle sensor. The method further includes storing a height of the window and a height of a window sill associated with the window. The method further includes determining, by the sun angle sensor, the angle of the sun, transmitting the angle of the sun to the motor controller, and driving the shade motor, by the motor controller, to wind or unwind the flexible shade material in response to the transmitted angle of the sun, the stored height of the window, and the stored height of a window sill to limit sunlight penetration through the window to a predetermined maximum distance into the room.

BRIEF DESCRIPTION OF THE DRAWINGS

The accompanying figures further illustrate the present invention. Exemplary embodiments are illustrated in reference figures of the drawings. It is intended that the embodiments and figures disclosed herein are to be considered to be illustrative rather than limiting.

The components in the drawings are not necessarily drawn to scale, emphasis instead being placed upon clearly illustrating the principles of the present invention. In the drawings, like reference numerals designate corresponding parts throughout the several views.

LIST OF REFERENCE NUMBERS FOR THE MAJOR ELEMENTS IN THE DRAWINGS

Figure 1:
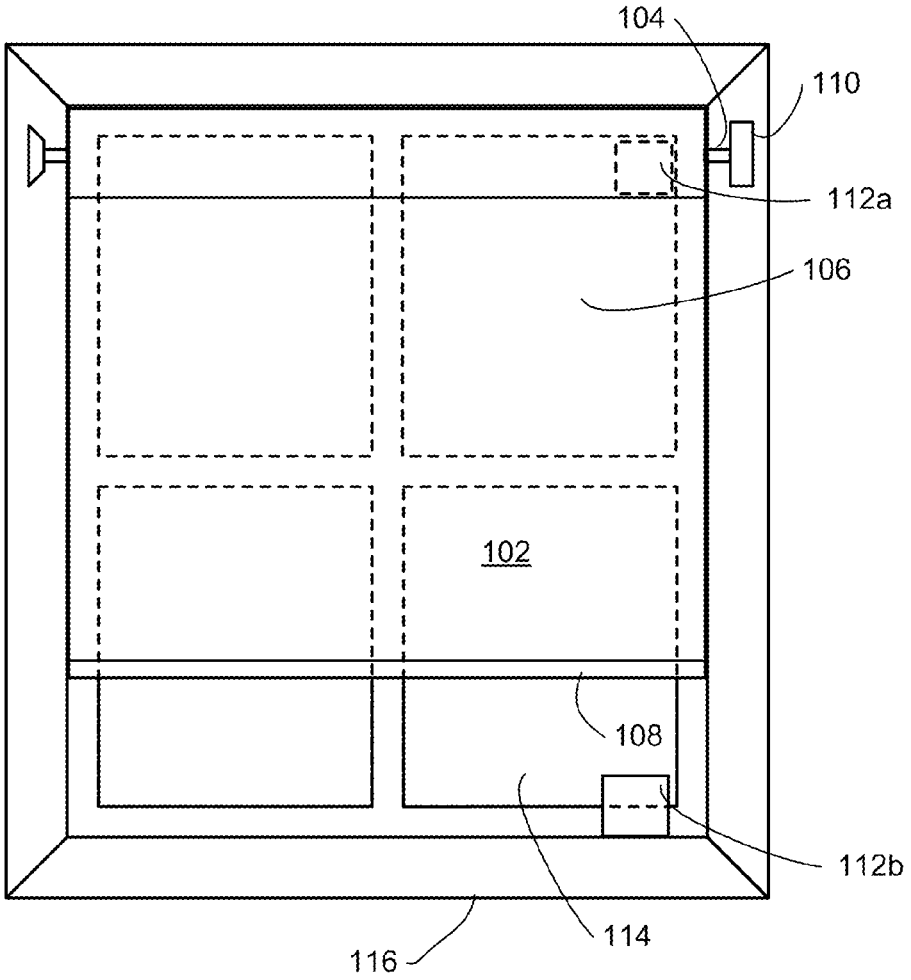
FIG. 1 is an illustrative diagram of a motorized roller shade employing a sun angle sensor, according to one embodiment of the invention.

The following is a list of the major elements in the drawings in numerical order.

102 roller shade
104 roller tube
106 flexible shade material
108 hembar
110 shade motor
112*a* sensor
112*b* sensor
114 window
116 window frame
118 window sill
202 motor controller
204 memory
206 controller interface
208 microcontroller/microprocessor
210 motor driver circuit
212 master controller
214 photovoltaic cell
216 microcontroller/microprocessor
218 communication interface
302 window
304 shade
306 sun rays
402 window
404 shade
406 sun rays

DETAILED DESCRIPTION OF THE INVENTION

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to".

Mode(s) for Carrying out the Invention

Disclosed is a motorized roller shade system that automatically adjusts the position of the shade to minimize UV penetration into a room and prevent glare on items, such as television screens, by specifying the maximum distance into a room from a window that direct sunlight may penetrate.

Figure 2:
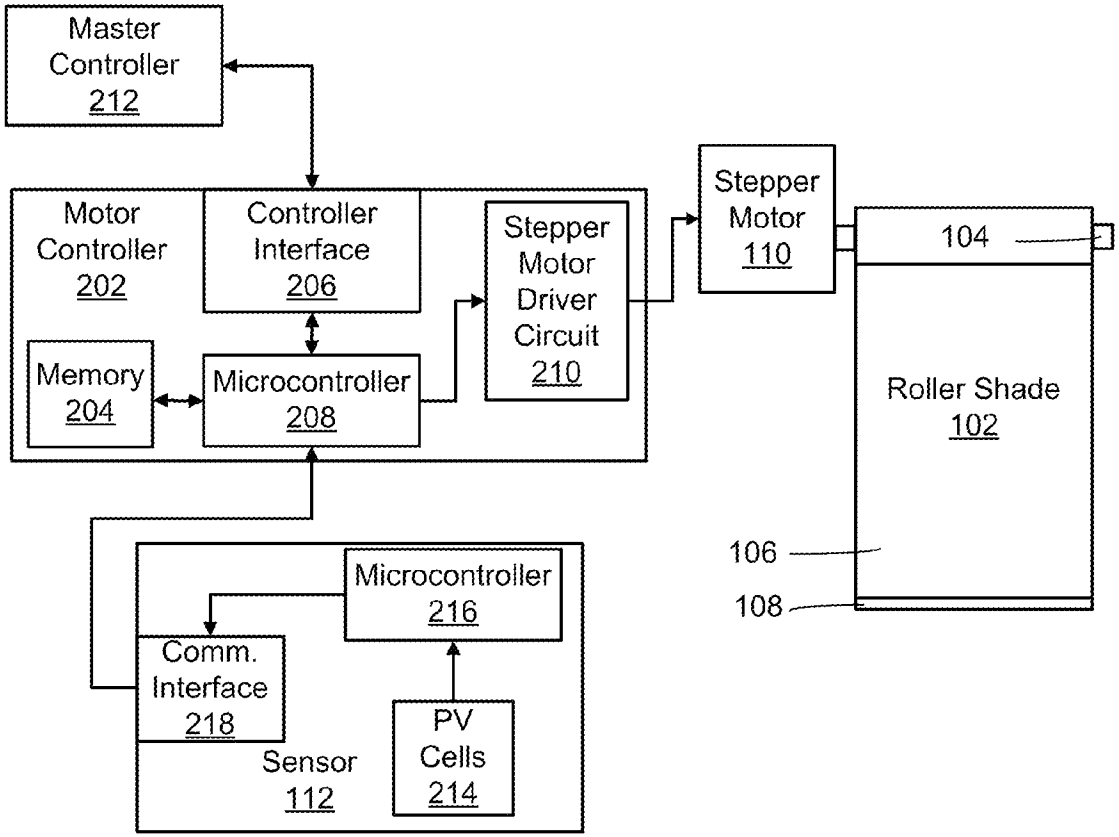
FIG. 2 is an illustrative block diagram of a motorized roller shade, motor controller, and sensor, according to one embodiment of the invention.

Referring to FIG. 1, in one embodiment, the shade system, which is designed to be mounted in a window frame 116 and cover window 114, includes a roller shade 102, a roller shade motor 110, and a sun angle sensor (generally 112). The roller shade 102 includes a roller tube 104, flexible shade material 106, and a hembar 108. The motor 110 is in wired communication with, and controlled by, a motor controller 202 (FIG. 2). The sensor 112 is in wired or wireless communication with the motor controller 202. In one embodiment, the sensor 112 is an integrated solar angle sensor E910.86 from Elmos, Inc. The sensor 112 is capable of determining the angle of light incidence in both xz- and yz-planes, with the z axis being perpendicular to the surface of the sensor 112, the x axis being parallel to the surface sensor and parallel to the surface of a window sill 118, and the y axis being parallel to the surface sensor and perpendicular to the surface of the window sill 118. In one embodiment, the sensor 112*a* is disposed on a surface of the window 114. In another embodiment, the sensor 112*b* is disposed on the window sill 118.

The motor controller 202 controls/drives the motor 110 and includes a microcontroller/microprocessor 208, a controller interface 206, a memory 204, and a motor driver circuit 210, which is in communication with the motor 110. The controller interface 206 is in wired or wireless communication with a master controller 212, which is capable of controlling one or more motor controllers 208. During installation of the roller shade system, the height (h) of the top of the window above the floor and the height (s) of the window sill are stored in the memory 204. In the case of a window that extends to the floor (i.e., no window sill), height s=0.

In various embodiments, the sensor 112, which is in wired or wireless communication with the microcontroller 208, includes at least one photovoltaic cell 214, a microcontroller/microprocessor 216, and a wired or wireless communication interface 218. The sensor 112 is removeably coupled to the window 114 or disposed on a window sill 118 in order to have an unobstructed view of the sun. If the sensor 112 is in wired communication with the microcontroller 208, the sensor 112 receives power through/from the motorized roller shade. If the sensor 112 is in wireless communication with the microcontroller 208, the sensor 112 is battery powered and/or solar powered.

The sensor 112 determines the angle of the sun based on sunlight incident thereon, and reports/transmits the sun angle to the microcontroller 208. The microcontroller 208 also retrieves height (h) and height (s) from memory 204. In response to receiving the sun angle and retrieving height (h) and height (s), the microcontroller 208 instructs the motor 110 (via the motor driver circuit 210) to move the roller shade 102 up or down to allow sunlight to enter a predetermined (user defined) distance (a) into a room. Because the sensor 112 detects actual light conditions, there is no need to specify the location (i.e., latitude and longitude) of the building or whether there are any obstructions between the window and the sun. Furthermore, the sensor 112 also determines the intensity of the sun and thus eliminates the need for additional sensors to detect clouds and/or shadows.

The disclosed roller shade system prevents furnishings, artwork, or other materials from being damaged by the sun's harmful ultraviolet (UV) rays. For example, if a user knows that all the items in a particular room that could be damaged by Ultraviolet rays are a minimum of five feet away from the windows, the disclosed roller shade system can be easily configured to allow direct sunlight to penetrate no more than five feet into the room.

Figure 3:
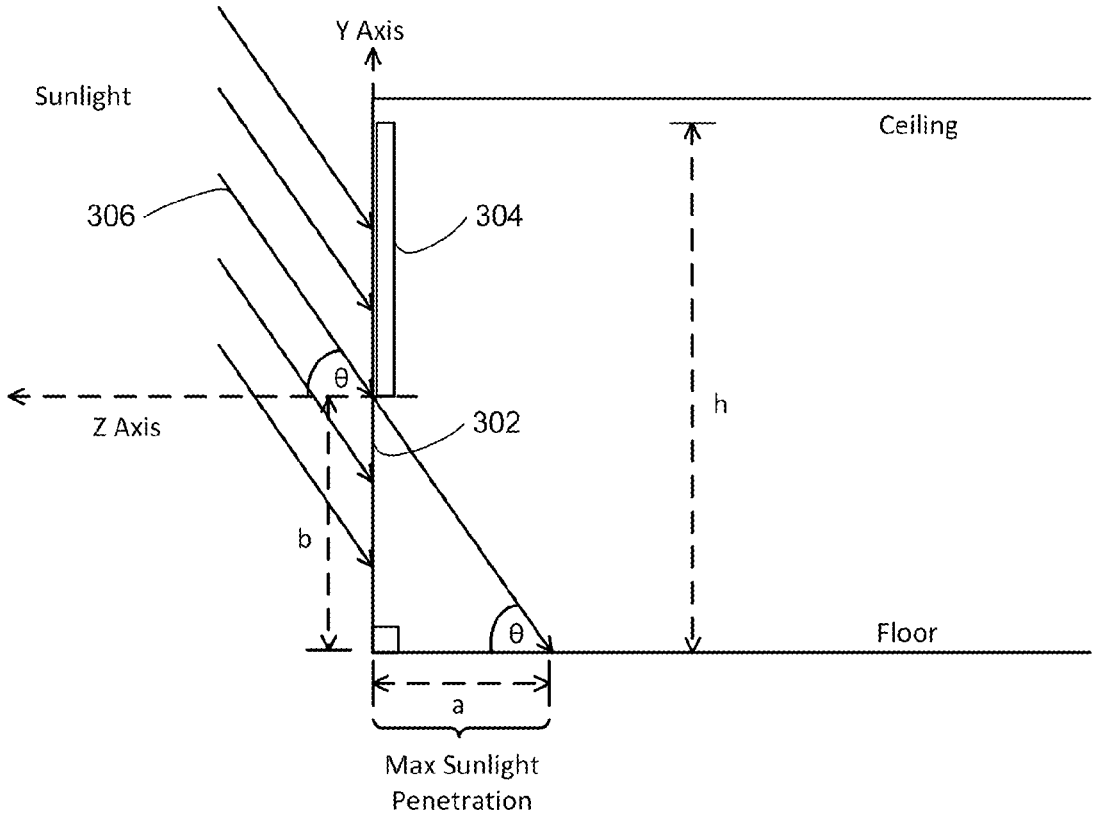
FIG. 3 is an illustrative diagram of a motorized roller shade position based on sun angle for a floor to ceiling window, according to one embodiment of the invention.

Referring to FIG. 3, in one embodiment, in operation with a floor to ceiling window 302, assume a user wants to position a shade 304 so that sunlight penetrates into a room a maximum distance (a) of five feet. Next assume that the distance (h) from the top of a window 302 employing the disclosed roller shade system to the floor is ten feet (i.e., shade length). Further assume that the sensor 112 determines that the angle (theta) of incidence of the sun rays 306 is 50 degrees, in the yz-plane relative to the z-axis. The distance b is the distance from the floor that the shade 304 needs to be raised to allow sunlight to penetrate into the room a maximum of five feet The distance b is determined using the equation: Tan (theta)=b/a. For the current example, b=Tan(50)*5=5.958≈6 feet, or 60 percent of the total shade length (i.e., 10 feet). In other words, the shade 304 must be 60 percent open to allow the incident light rays 306 to penetrate a distance of 5 feet into the room.

Figure 4:
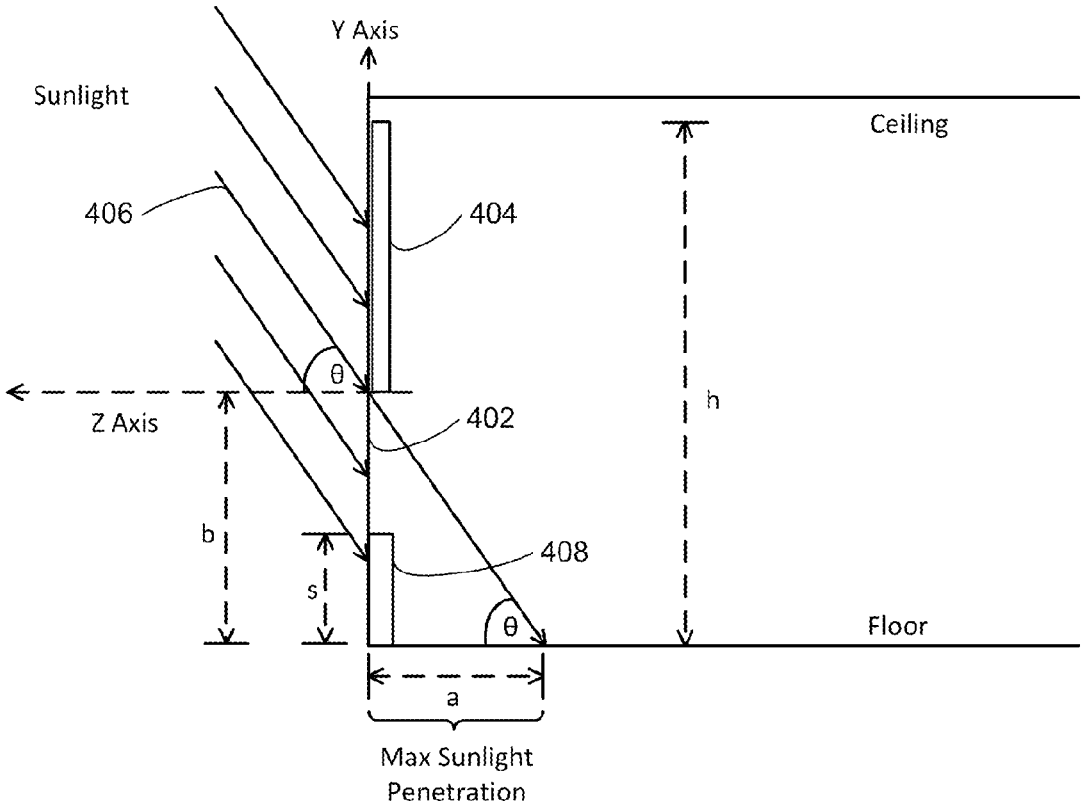
FIG. 4 is an illustrative diagram of a motorized roller shade position based on sun angle for a standard window, according to one embodiment of the invention.

Referring to FIG. 4, in another embodiment, in operation with a standard sized window 402, assume a user wants to position a shade 404 so that sunlight penetrates into a room a maximum distance (a) of five feet. Next assume that the distance (h) from the top of a window 402 employing the disclosed roller shade system to the floor is ten feet and that the height (s) of the window sill is two feet. Further assume that the sensor 112 determines that the angle (theta) of incidence of the sun rays 406 is 50 degrees, in the yz-plane relative to the z-axis. In this example, the relative position (RP) that the shade 404 needs to be raised to allow sunlight to penetrate into the room a maximum of five feet is determined by the equation RP=(b/(h−s))*100.

The distance b is determined using the equation: Tan (theta)=b/a. For the current example, b=Tan(50)*5=5.958≈6 feet. Using the above described equation, RP=(6/(10−2))*100=75% open. In other words, the shade 404 must be 75 percent open to allow the incident light rays 406 to penetrate a distance of 5 feet into the room.

As mentioned above, the sensor 112 is capable of determining the angle of light incidence in both xz- and yz-planes, with the z axis being perpendicular to the surface of the sensor 112, the x axis being parallel to the surface sensor and parallel to the surface of the window sill 118, and the y axis being parallel to the surface sensor and perpendicular to the surface of the window sill 118. Consequently, the sensor can be used with drapery tracks, vertical blinds, venetian blinds, or any other type of motorized window treatment. In the case of the sensor 112 being used with drapes or vertical blinds, a user can set a maximum horizontal width that direct sunlight covers, rather than the maximum distance that direct sunlight may penetrate.

In another embodiment, the sensor additionally includes a memory configured for storing the height (h), the height (s), and the maximum distance sunlight is allowed to penetrate into the room. After the sensor determines the angle of the sun, the microcontroller/microprocessor performs the calculations described above to determine the percentage open (e.g., 0=closed, 100=fully open, 50=50% open) the shade needs to be to limit the sunlight penetration into the room to the predetermined maximum distance. The sensor then transmits the percentage open to the shade motor, which moves the flexible shade material to the appropriate position.

Alternative Embodiments

Variations, modifications, and other implementations of what is described herein may occur to those of ordinary skill in the art without departing from the spirit and scope of the invention. Accordingly, the invention is not to be defined exclusively by the preceding illustrative description.

What is claimed is:

1. A motorized roller shade system, comprising:

a flexible shade material;

a roller tube dimensioned and arranged for mounting over a window having a window sill and configured for windingly receiving the flexible shade material;

a shade motor coupled to the roller tube;

a memory configured for storing a height of the window and a height of the window sill:

a motor controller in communication with the memory and the shade motor; and a sun angle sensor configured for determining the angle of the sun and transmitting the angle of the sun to the motor controller, the motor controller being configured for retrieving the stored height of the window and the stored height of the window sill from the memory and driving the shade motor to rotate the roller tube to wind or unwind the flexible shade material in response to the stored height of the window, the stored height of the window sill, and the transmitted angle of the sun to limit sunlight penetration through a window to a user defined maximum distance into a room.

2. The motorized roller shade system of claim 1, wherein the motor controller comprises a microcontroller, a controller interface, a memory, and a motor driver circuit in communication with the motor.

3. The motorized roller shade system of claim 1, wherein the sun angle sensor is solar powered.

4. The motorized roller shade system of claim 1, wherein the sun angle sensor transmits the angle of the sun to the motor controller through one of a wired connection and a wireless connection.

5. A method of limiting the maximum distance sunlight penetrates through a window into a room, the method comprising:

providing for the window a roller shade comprising a flexible shade material, a motor, a motor controller, and a sun angle sensor;

storing a height of the window and a height of a window sill associated with the window;

determining, by the sun angle sensor, the angle of the sun;

transmitting the angle of the sun to the motor controller;

driving the shade motor, by the motor controller, to wind or unwind the flexible shade material in response to the transmitted angle of the sun, the stored height of the window, and the stored height of a window sill to limit sunlight penetration through the window to a user defined maximum distance into the room.

* * * * *